US011484074B2

(12) United States Patent
Brown

(10) Patent No.: US 11,484,074 B2
(45) Date of Patent: Nov. 1, 2022

(54) GARMENT WITH CONVERTIBLE ARM SLEEVES

(71) Applicant: Wendy K. Brown, Ocean City, NJ (US)

(72) Inventor: Wendy K. Brown, Ocean City, NJ (US)

(73) Assignee: Abby Lange, LLC, Ocean City, NJ (US)

( * ) Notice: Subject to any disclaimer, the term of this patent is extended or adjusted under 35 U.S.C. 154(b) by 0 days.

(21) Appl. No.: 16/708,905

(22) Filed: Dec. 10, 2019

(65) Prior Publication Data

US 2021/0169163 A1 Jun. 10, 2021

(51) Int. Cl.
*A41D 27/10* (2006.01)

(52) U.S. Cl.
CPC ..... *A41D 27/10* (2013.01); *A41D 2400/70* (2013.01); *A41D 2500/00* (2013.01)

(58) Field of Classification Search
CPC ..... A41D 27/10; A41D 2400/70; A41D 2500/00; A41D 15/00
See application file for complete search history.

(56) References Cited

U.S. PATENT DOCUMENTS 2,073,711 A * 3/1937 Robinsohn ..... A41D 27/28 2/93
2,465,286 A * 3/1949 Silversteen ..... A41D 13/02 2/51
4,006,495 A * 2/1977 Jones ..... A41D 27/10 2/93
4,122,553 A * 10/1978 Pitkanen ..... A41D 15/00
5,182,812 A * 2/1993 Goldsby ..... A61H 36/00 2/227
6,298,485 B1 * 10/2001 Heller ..... A41D 3/005 2/126
2006/0137075 A1 6/2006 Gheneva
2008/0168590 A1 * 7/2008 Bousquet ..... A41D 1/04 2/74
2010/0299798 A1 * 12/2010 Fayle ..... A41D 27/28
2011/0207992 A1 12/2011 Martinson
2014/0250565 A1 * 9/2014 Willows ..... A41D 19/0006 2/160
2016/0120241 A1 * 5/2016 Rose ..... A41D 15/00
2017/0251733 A1 * 9/2017 Sorrentino ..... A41D 3/00
2018/0242660 A1 8/2018 Giangeruso
2020/0138137 A1 * 5/2020 Eckensweiler ..... A41D 27/10

FOREIGN PATENT DOCUMENTS

EP 0834265 A1 4/1998
GB 29869 A 6/1910

OTHER PUBLICATIONS

ISA, "International Search Report", PCT/US20/61752, dated Feb. 9, 2021.

* cited by examiner

*Primary Examiner* — Khoa D Huynh
*Assistant Examiner* — Erick I Lopez
(74) *Attorney, Agent, or Firm* — Intrinsic Law Corp.

(57) ABSTRACT

A garment worn on the upper body is disclosed wherein the garment has partially but permanently attached convertible arm sleeves allowing wearing of the garment in a sleeves-on configuration or in a sleeves-off configuration, said arm sleeves always remaining partially attached to a garment body of the garment, and wherein the arm sleeves in the sleeves-off configuration can be left loose, folded, tied or otherwise secured on the garment, or to one another.

14 Claims, 17 Drawing Sheets

GARMENT WITH CONVERTIBLE ARM SLEEVES

TECHNICAL FIELD

The present application relates to wearable garments, specifically upper body garments having arm sleeves that have multiple modes of use.

BACKGROUND

Garments with detachable or convertible parts have been available for some time. For example, some garments have detachable sleeves for shirts and jackets, typically attaching and detaching to an upper body (torso) portion of the garment by some means. Other garments have detachable pant legs, at or near the knees, to convert the pants between a long pant garment and a short pant garment. Yet other garments like winter coats or windbreakers can have detachable hoods, which are optionally removed by the user for functional or aesthetic reasons.

Typically, the removable part of the garment is attached to a body of the garment by a zipper, buttons, hook-and-loop strips, or other means. When the removable part is detached, it is completely separated from the garment, leaving the user to store the detached portions (e.g., sleeves) in his or her pockets, handbag, or otherwise needing to carry or store the detached garment parts. Obviously, this solution is inconvenient as the detached portions can be lost, dropped and soiled, or at a minimum be a nuisance to carry and store until needed further.

In the example of detachable sleeves, these convertible garments allow for stylistic or functional conversion allowing substitution of multiple sleeve colors in some examples, or allowing the user to wear the sleeves on or off depending on the environmental temperature, for example, by removing the sleeves in the summer if the wearer wishes to have a sleeveless configuration on account of the ambient temperature.

As mentioned, the above garments are not ideal insofar as, for example, children are prone to misplacing detached garment parts such as sleeves and losing them. Other users may find it cumbersome or unsightly to be required to carry around the detached garment parts, for example if the wearer does not have pockets or a bag into which to place and store the loose items.

The present disclosure provides a number of solutions to the above matter where it is desired to have a garment with convertible arm sleeves, but where it is not desired to fully detach and store or carry the detached sleeve parts.

SUMMARY

The invention is directed to garments with convertible sleeves. The convertible sleeves are convertibly attached to a garment body (worn on the wearer's torso) where the sleeves are partially permanently attached to the body at respective attachment locations, which can be a subset of the circumference of each respective arm hole, opening or armscye.

One or more embodiments provide garment having convertible arm sleeves, comprising a garment body; the garment body having a right arm opening and a left arm opening through which a wearer's arms may extend; a left arm sleeve, having an upper portion partially yet permanently connected to said garment body along a portion of a perimeter of said left arm opening of the garment body so that the left arm sleeve is convertibly coupled to said garment body proximal to said left arm opening; and a right arm sleeve, having an upper portion partially yet permanently connected to said garment body along a portion of a perimeter of said right arm opening of the garment body so that the right arm sleeve is convertibly coupled to said garment body proximal to said right arm opening; wherein the left and right arm sleeves and respective connection locations on the garment body accommodate one or both of said arm sleeves to be worn on the wearer's arms in a sleeves-on configuration or to be worn off of the wearer's arms in a sleeves-off configuration.

One or more embodiments provide a garment having convertible arm sleeves, comprising a garment body; the garment body having a right arm opening and a left arm opening through which a wearer's arms may extend; a left arm sleeve, having an upper portion partially yet permanently connected to said garment body at a left arm sleeve connection location so that the left arm sleeve is convertibly coupled to said garment body proximal to said left arm opening; and a right arm sleeve, having an upper portion partially yet permanently connected to said garment body at a right arm sleeve connection location so that the right arm sleeve is convertibly coupled to said garment body proximal to said right arm opening; wherein the left and right arm sleeves and respective connection locations on the garment body accommodate one or both of said arm sleeves to be worn on the wearer's arms in a sleeves-on configuration or to be worn off of the wearer's arms in a sleeves-off configuration.

Some embodiments connect the convertible arm sleeves to the garment body in various connection locations so that the sleeves are partially permanently attached to the garment body yet partially open to permit conversion.

Yet other aspects provide for stretchable fabric in the making of the garment.

BRIEF DESCRIPTION OF THE DRAWINGS

For a fuller understanding of the nature and advantages of the present invention, reference is made to the following detailed description of preferred embodiments and in connection with the accompanying drawings, in which.

DETAILED DESCRIPTION

Figure 1A:
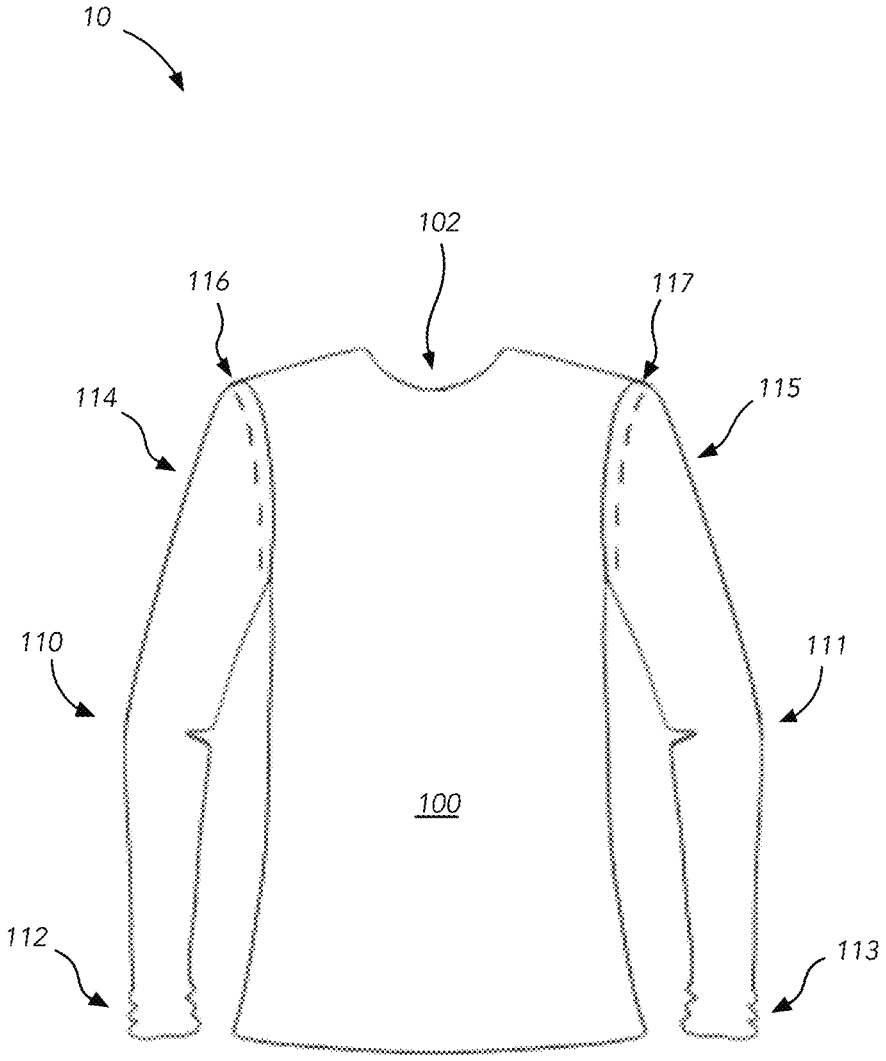
FIG. 1A illustrates a front view of a garment and partially attached sleeve in its sleeves-on configuration according to one or more embodiments.

FIG. 1A illustrates a front view of a preferred but non-limiting embodiment of a garment 10. FIG. 1A specifically illustrates a front view of a garment and partially attached sleeve in its sleeves-on configuration according to one or more embodiments. Garment 10 includes a garment body 100, which is worn over the torso of a wearer's body. A pair of sleeves 110 (right arm), 111 (left arm) are permanently affixed to the garment body 100 in a novel and convertible way that will be described in more detail below. In use, the wearer's head and neck extend from neck opening 102 at the top of the garment as they would when wearing a conventional shirt, blouse, vest, sweater, jacket, etc. The neck opening 102 may be provided with various shapes, collars and other features as known to those skilled in the art. The garment body 100 may be made of any suitable material, may be open or closed in front and/or back, and may be equipped with accessories such as pockets, zippers, buttons, a waist belt, shoulder pads or other adornments as seen fit by its designer and manufacturer. For simplicity, most such adornments and accessories are not illustrated herein, but those skilled in the art will appreciate how to enhance or modify the present illustrative examples to suit a particular requirement. The present invention and concepts can be useful for wearers of all sorts including adults, children, as well as men and women.

Each sleeve (110, 111) has an upper end (114, 115) proximal to the wearer's shoulder and a lower end (112, 113) closer to the wearer's hands. While the examples illustrate a long-sleeve design, those skilled in the art will appreciate that other sleeve designs are also possible, for example sleeves of varying length and width, some of which will be illustrated herein. Importantly, the sleeves 110, 111 are permanently sewn, glued, woven, or otherwise affixed and attached to the garment body 100 at respective attachment locations 116, 117. In use, a wearer can place his or her arms through the garment's arm openings so as to wear the sleeves 110, 111 on the user's arms (e.g., if it is chilly) in a first "sleeves-on" configuration as shown in FIG. 1A.

Figure 1B:
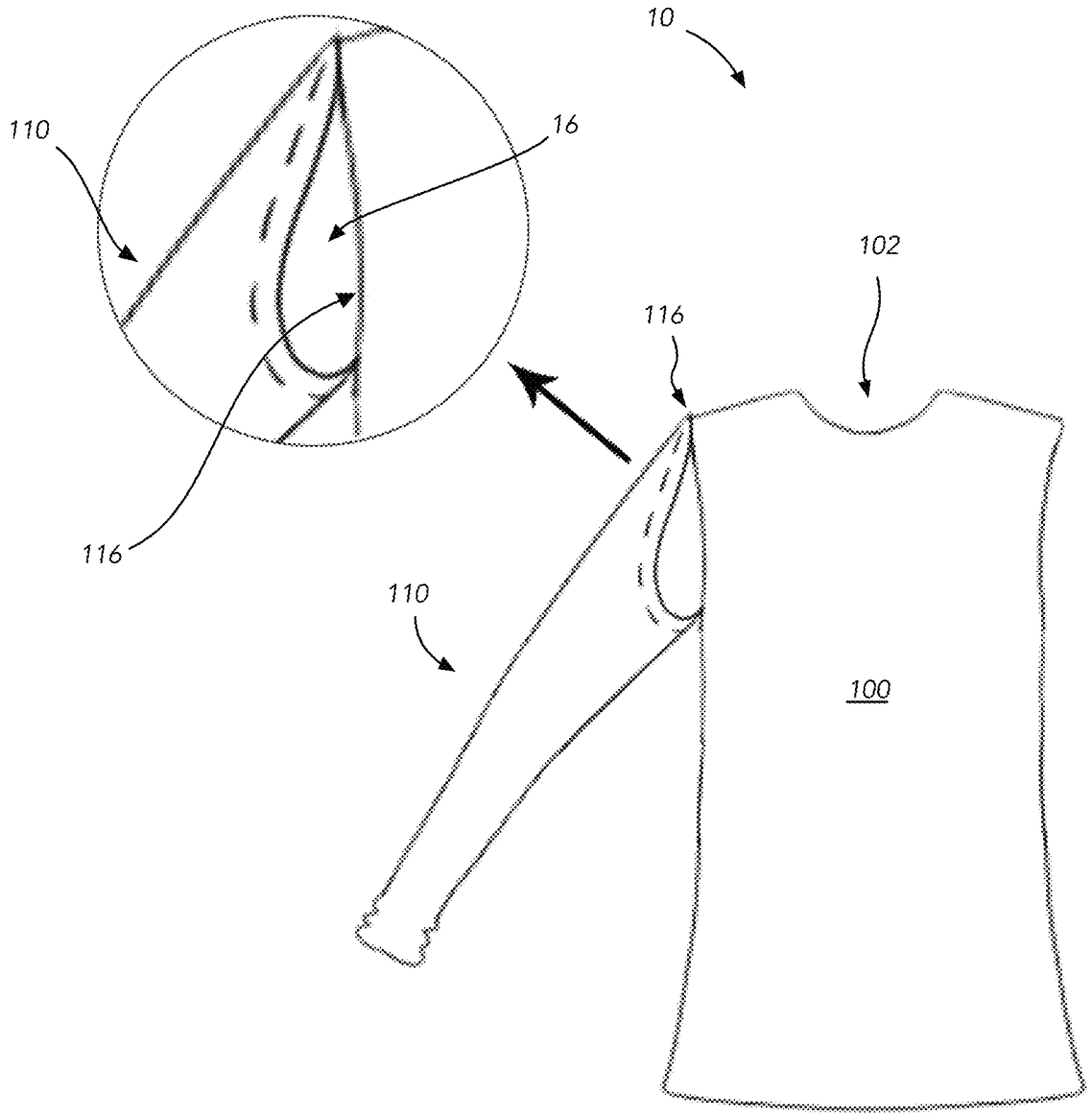
FIG. 1B illustrates a front view of the garment of FIG. 1A with said sleeve pulled away from the garment body to reveal the (right arm) arm hole opening and detail of the arm opening/armscye area. The other (left arm) sleeve is not shown for simplicity.

FIG. 1B illustrates another front view of the garment 10 with sleeve 110 partially pulled away from the garment body to open up and reveal the (right arm) arm hole opening and detail of the arm opening/armscye area. The other (left arm) sleeve is not shown for simplicity. It can be seen that the wearer can now extend his or her arm out of right arm hole 16 to take off the sleeve if desired or can retract his or her arm back into the sleeve to wear the sleeve. It can also be seen that in this non-limiting embodiment the sleeve 110 is (permanently) attached to the garment body 100 substantially at a rearward portion or attachment location 116 thereof so that the arm hole 16 is towards a forward portion of the garment 10 overall. However, sleeve 110 can be attached to garment body 100 at other locations along the arm hole at different attachment locations if desired, so this example is not limiting.

Figure 1C:
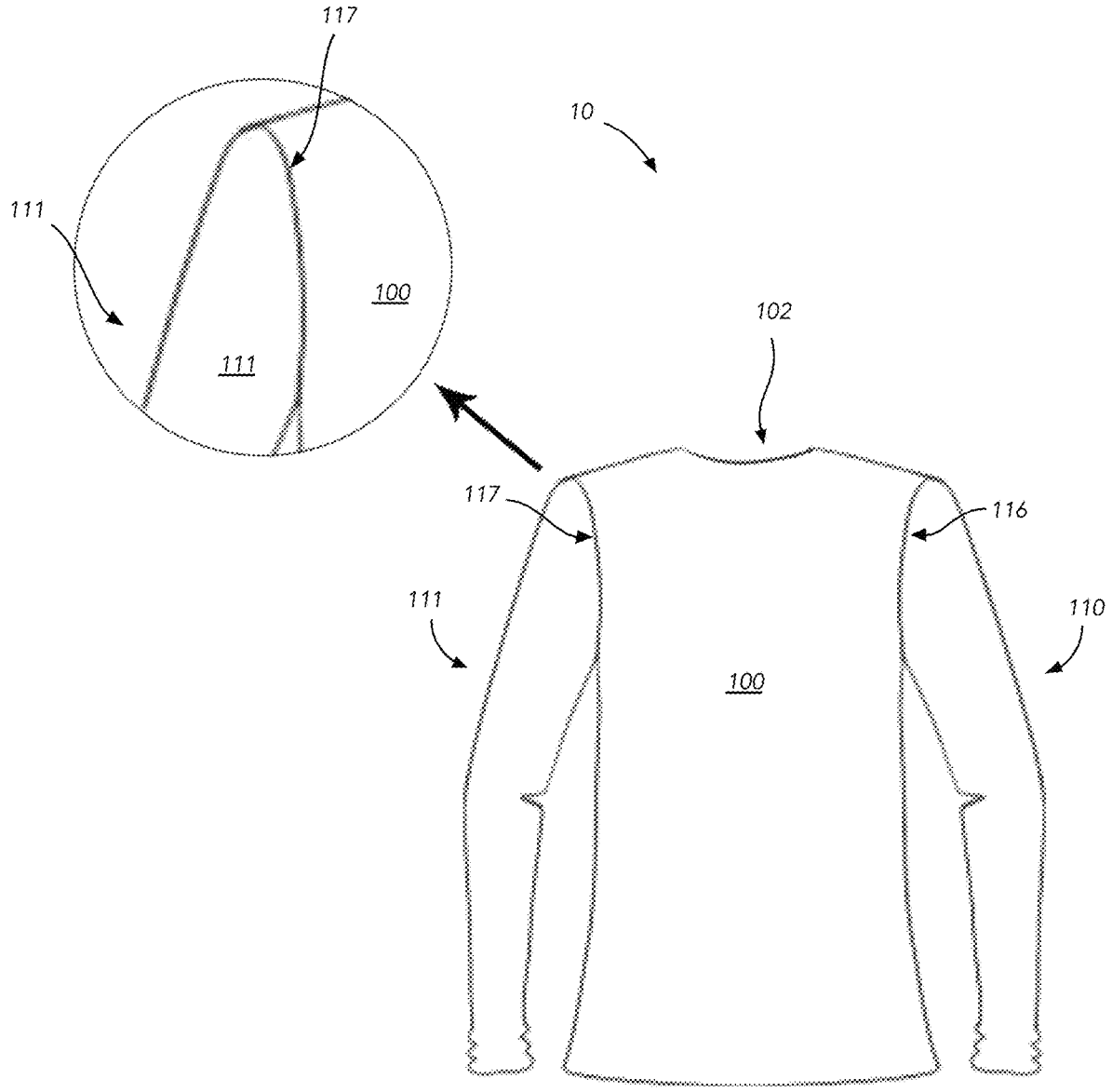
FIG. 1C illustrates the garment of FIGS. 1A and 1B from the back according to one or more embodiments.

FIG. 1C illustrates the garment of FIGS. 1A and 1B from the back according to one or more embodiments. We see that the left and right arm sleeves (111, 110) are permanently sewn to the corresponding attachment locations (117, 116) on garment body 100 proximal to the respective previously-described arm holes.

In addition to the "sleeves-on" configuration whereby the wearer wears the arm sleeves 110, 111 on his or her arms, the wearer can pull his or her arms out of the sleeves 110, 111, leaving the sleeves 110, 111 attached to the garment body 100 at said attachment locations 116, 117 (e.g., if it is hot) in a second "sleeves-off" configuration as shown from the back in the following figure.

Figure 2:
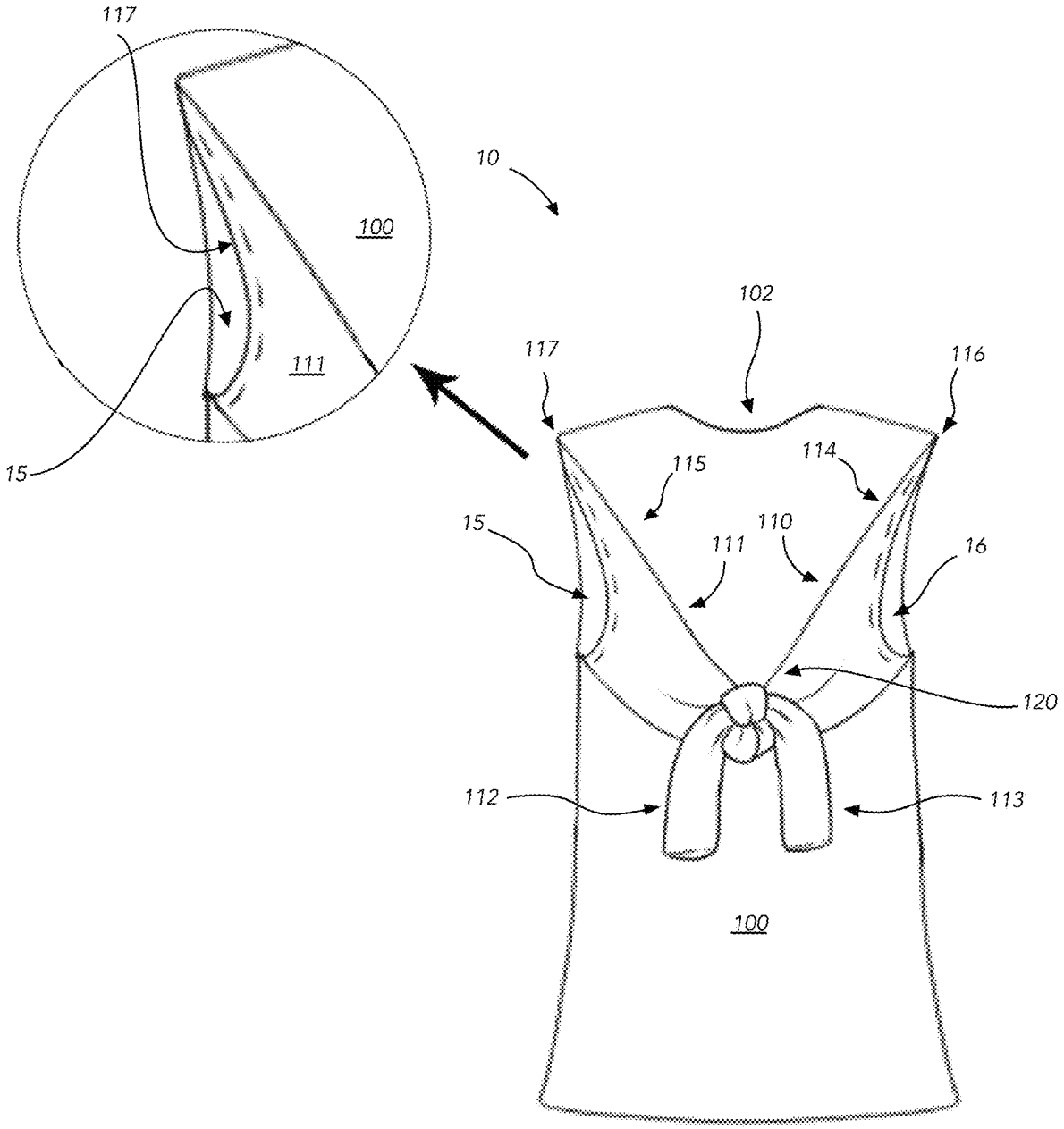
FIG. 2 illustrates a back view of a garment in a sleeves-off configuration.

FIG. 2. shows a rear view of garment body 100. Sleeves 110, 111 are off of the wearer's arms and are placed behind the wearer allowing the wearer to use the garment 10 in a sleeves-off configuration. The closeup view above shows the area around the left arm hole 15 where the left sleeve is partially permanently sewn to the garment body 100 at attachment location 117 yet is partially unattached to reveal said opening 15 through which the wearer's left arm can be inserted or retracted. As an example, but not by way of limitation, we see that the sleeves 110, 111 may be tied, knotted, looped, wound or otherwise coupled behind the user's back (e.g., in a bow or knot 120) for convenience or for a stylish look. The arm sleeves 110, 111 can be similarly coupled using other means such as a lanyard connected to one or both arms, lace, snaps, magnet connections, hook and loop couplings and so on without loss of generality. A closeup view shows how the arm sleeves (e.g., left sleeve 111) is stitched to the garment body 100 at or near the shoulder thereof, e.g., along the attachment location 116.

Therefore, the sleeves (110, 111) while always permanently connected to their respective attachment locations (116, 117) on garment body 100, are convertible between said two configurations so as to allow the wearer to have the arm sleeves on or off but without detaching the arm sleeves 110, 111 completely from the garment. This feature provides certain style and practicality advantages and avoids the need to stow the sleeves had they been detachable as with some prior art designs. The discussion below will illustrate various optional examples of managing the present convertible arm sleeves in some exemplary embodiments.

In an aspect of one or more embodiments, the arm openings or armscye portion of garment 10 is partially open (to allow for slipping the arms in and out of their sleeves) but is also partially closed (to keep the sleeves permanently affixed to their respective attachment locations on the garment body). In a specific but non-limiting example, the garment 10 comprises arm openings and armscyes having a first (free) side and a second (connected) side, the free side allowing an opening for extracting and inserting one's arms, and the connected side securing the respective sleeve to its garment body connection location. The right and left arm openings may be of any suitable shape or size or configuration, depending on the design of the garment, sleeves, or the wearer's body. The permanent attachment locations can also take on any suitable size or configuration depending on similar factors.

In an example, the arm sleeves 110, 111 are connected to the garment body 100 at a portion (less than all but more than some) of the circumference of the respective arm openings. In yet a specific example, the connection locations for the arm sleeves are located towards the back (dorsal) part of the armscyes/arm openings (the forward part of the armscyes being free) so that a wearer's arms can be placed in and out of the sleeves more easily. However, as stated, other attachment locations can be defined as appropriate for a given type of garment, wearer or style.

Figure 3:
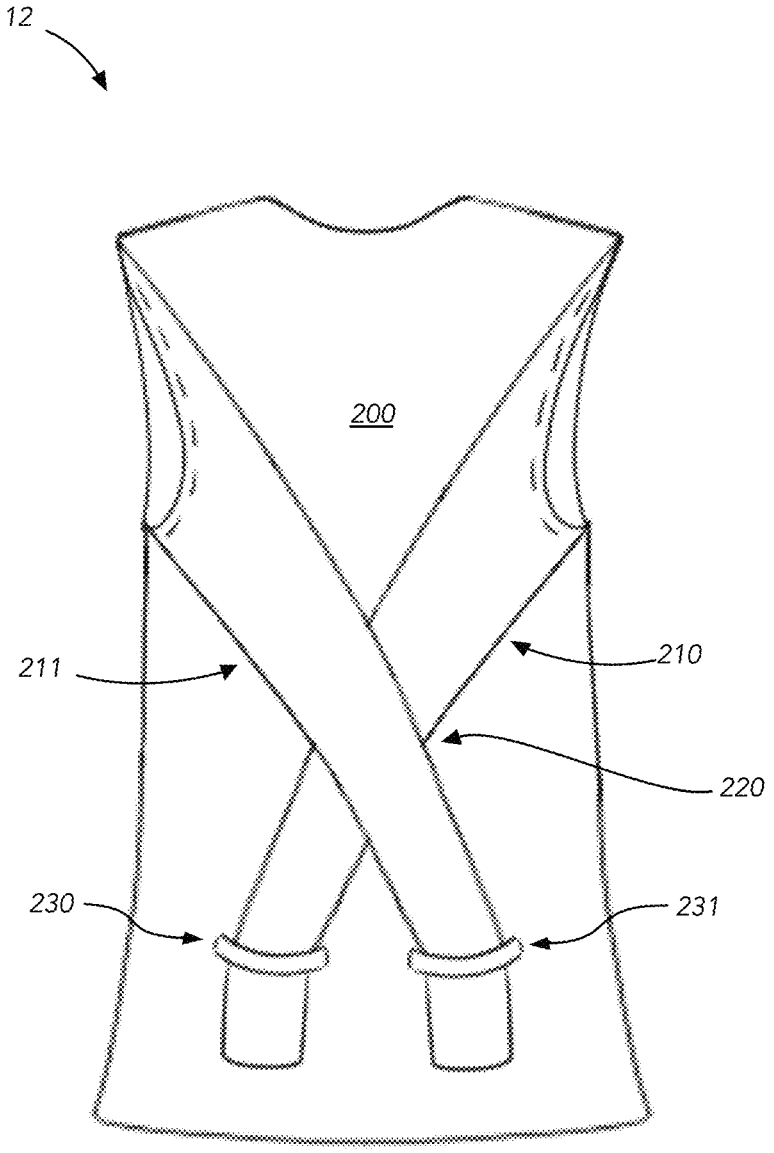
FIG. 3 illustrates an exemplary back view of a garment in a sleeves-off configuration.

FIG. 3 shows an exemplary back view of a garment 12 according to the invention, which comprises a garment body 200 and a pair of arm sleeves 210 and 211, the garment being worn in a sleeves-off configuration. From the front, garment 12 may appear similar to that shown before in FIG. 1.

The arm sleeves 210, 211 are placed behind the wearer's back and into a pair of sleeve stays 230, 231 connected to the back of garment body 200. The sleeve stays may be made of any suitable material, including a same or similar material as the material from which the main garment parts are made (e.g., cotton, wool, polyester, silk, linen, etc.) or may be made from a more durable material (e.g., leather, rubber, hemp, polymer, etc.). The sleeve stays 230, 231 are in a simple embodiment loops that are sized and placed at any convenient place of the garment body, which can include on the back, on the front or on the sides of garment body 200 so as to hold and comfortably secure the ends of sleeves 210, 211. The sleeve stays may comprise a stretchable elastic band so as to more securely hold down the sleeves to avoid the sleeves from falling out with movement of the wearer.

In an optional embodiment the sleeves 210, 211 may be crossed as shown at a crossing point 220 in an "X" configuration (behind or in front of the wearer) so that the ends of each sleeve (210, 211) are placed into the sleeve respective opposing side sleeve stay (230, 231). In another optional embodiment (not shown but understandable to anyone skilled in the art) the sleeves (210, 211) may be placed in a not-crossed configuration and inserted into the sleeve stays (231, 230 respectively) on the same side of the wearer.

Figure 4:
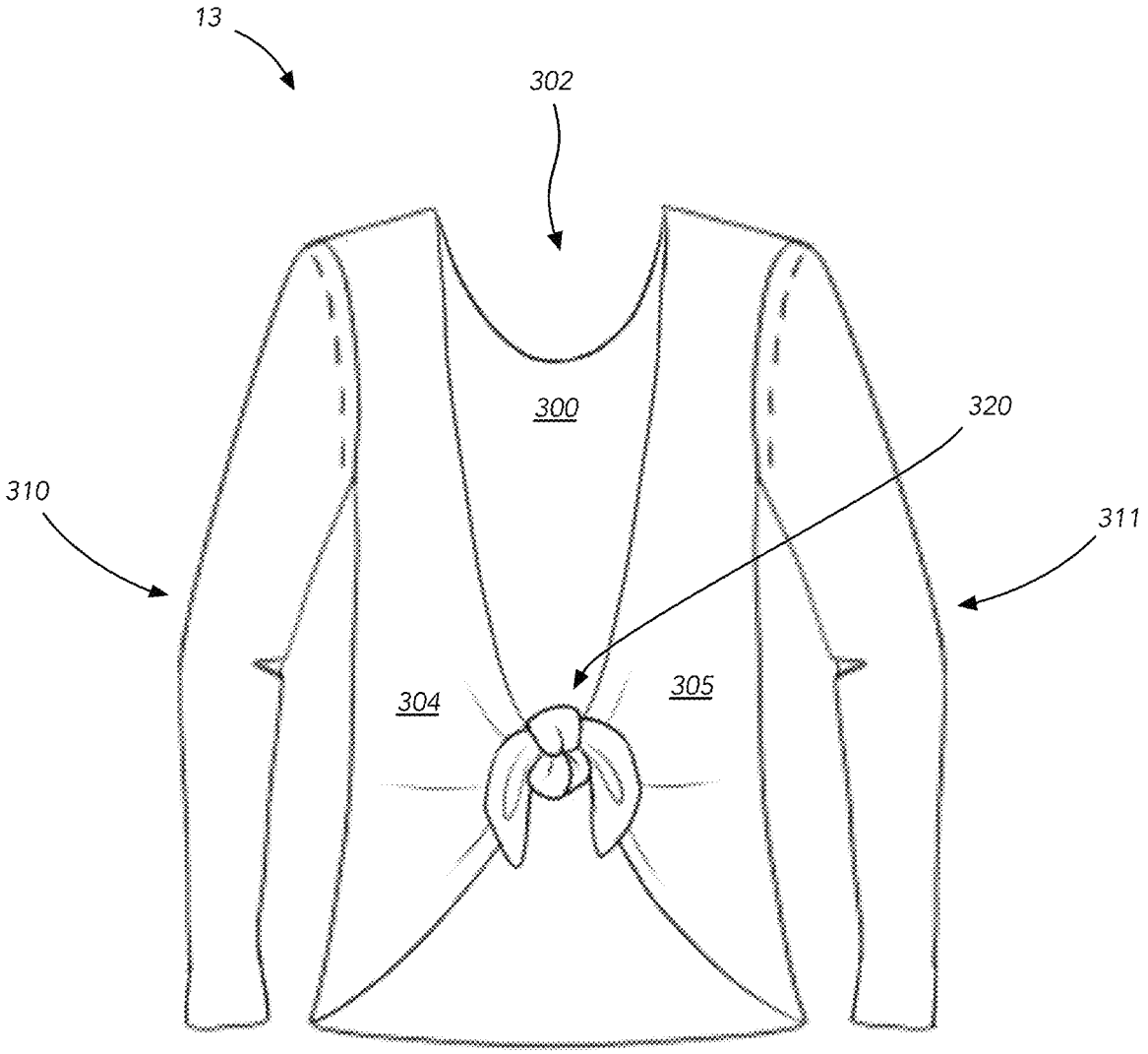
FIG. 4 illustrates a garment with sleeves in the sleeves-on configuration from the front according to an embodiment.

FIG. 4 shows a front view of yet another example of the invention comprising a garment 13 having a garment body 300 and a pair of arm sleeves 310, 311 and a neck/head opening 302. This view shows the garment in a sleeves-on configuration. This exemplary garment 13 includes a "butterfly" feature with an opposing pair of flaps or "wings" 304, 305 that are joined at 320 in a forward-worn position as one non-limiting option. In this example, the wings 304 and 305 may be sewn or attached to the garment body 300 along respective vertical seams running from the armpit region down to the bottom of the garment.

Figure 5:
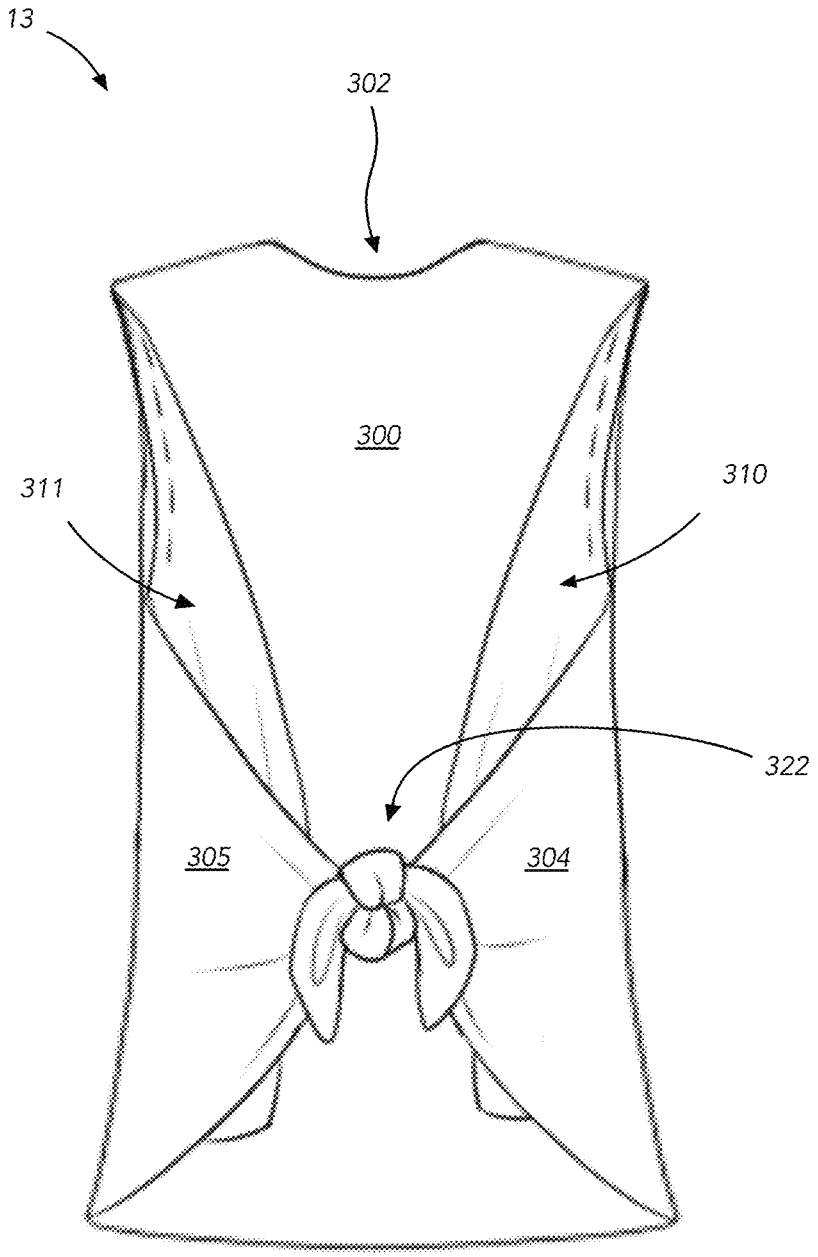
FIG. 5 illustrates the previous embodiment in a sleeves-off configuration from the back.

FIG. 5 shows the garment 13 in a sleeves-off configuration from the back. Here, the sleeves 310, 311 as well as the optional butterfly wings or flaps 304, 305 are joined behind the back in a knot, bow, or other tie 322 as suits the designer and wearer of the garment. This example thus has two types of element that are convertible between a front-worn and/or sleeves-on configuration and a back-worn and/or sleeves-off configuration. The tied butterfly wings or flaps allow the wearer to tuck the sleeves 310, 311 thereinto for convenience.

Figure 6:
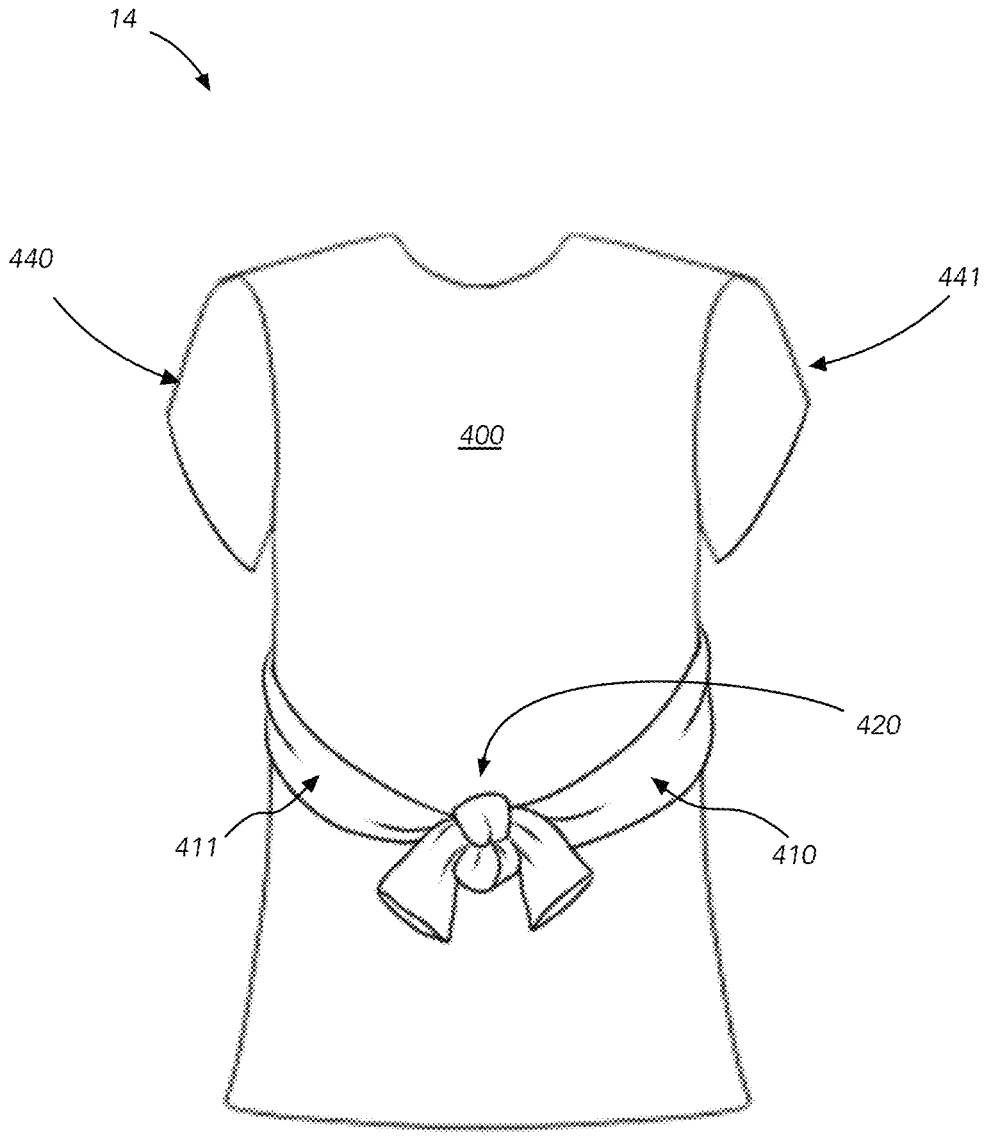
FIG. 6 illustrates another way of securing the sleeves in a sleeves-off configuration as seen from the front.

FIG. 6 illustrates still another front view of a garment 14 according to some embodiments. The garment 14 comprises a garment body 400. The garment is also permanently affixed to a pair of convertible arm sleeves, e.g., long sleeves 410 and 411. Here, the convertible sleeves 410 and 411 are shown in the sleeves-off configuration, and are wrapped around the wearer's back, returning to the front and tied together in front of the wearer in bow 420. As said before, other arrangements for connecting or tying can be employed.

In addition, the garment 14 comprises a pair of short sleeves 440 and 441, which are permanently and completely attached to the respective arm openings of garment body 400. While the long convertible sleeves 410, 411 are permanently attached at the partial attachment locations described before, the short sleeves 440, 441 are not convertible and are sewn or permanently attached to the armscyes or the arm openings around their entire circumference. In this example, removing one's arms from the long convertible sleeves still allows a short sleeve to cover the upper portions and shoulders of the wearer.

Figure 7:
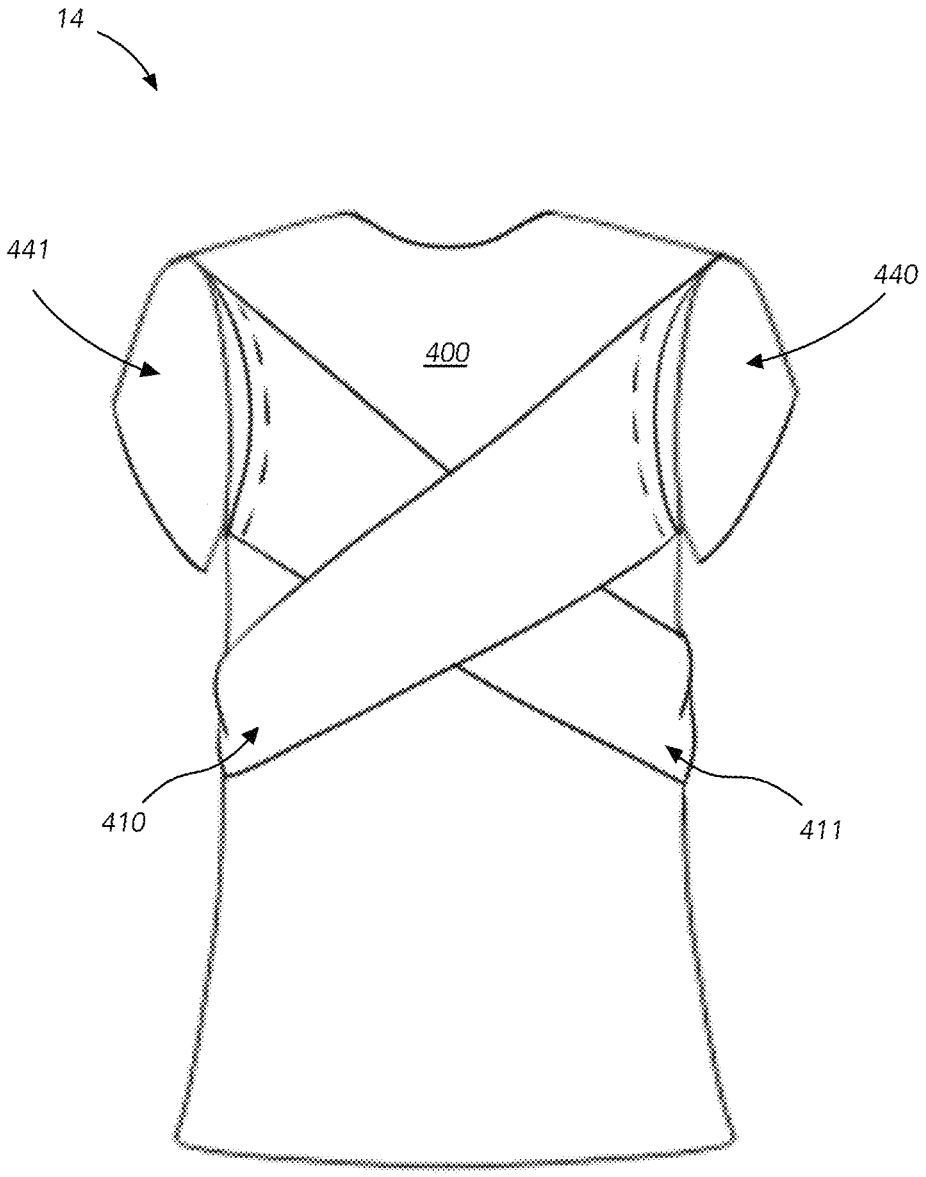
FIG. 7 illustrates the garment of the previous embodiment from the back.

FIG. 7 shows the garment 14 of the previous embodiment from the back. As mentioned, the long sleeves 410, 411 are convertible to the shown sleeves-off configuration. Short sleeves 440, 441 remain on the wearer's upper arms as they are not convertible and are always completely attached to the respective arm openings on the garment. Thus, instead of converting between fully sleeved and non-sleeved configurations, this example converts between a long-sleeve configuration and a short-sleeve configuration on account of having two pairs of arm sleeves involved, one set long and convertible and the other set short and non-convertible. The long convertible sleeves 410, 411 are thus nested over the short sleeves 440, 441 respectively when the garment is in the sleeves-on configuration, with the short sleeves disposed inside the upper portions of the long sleeves.

Figure 8A:
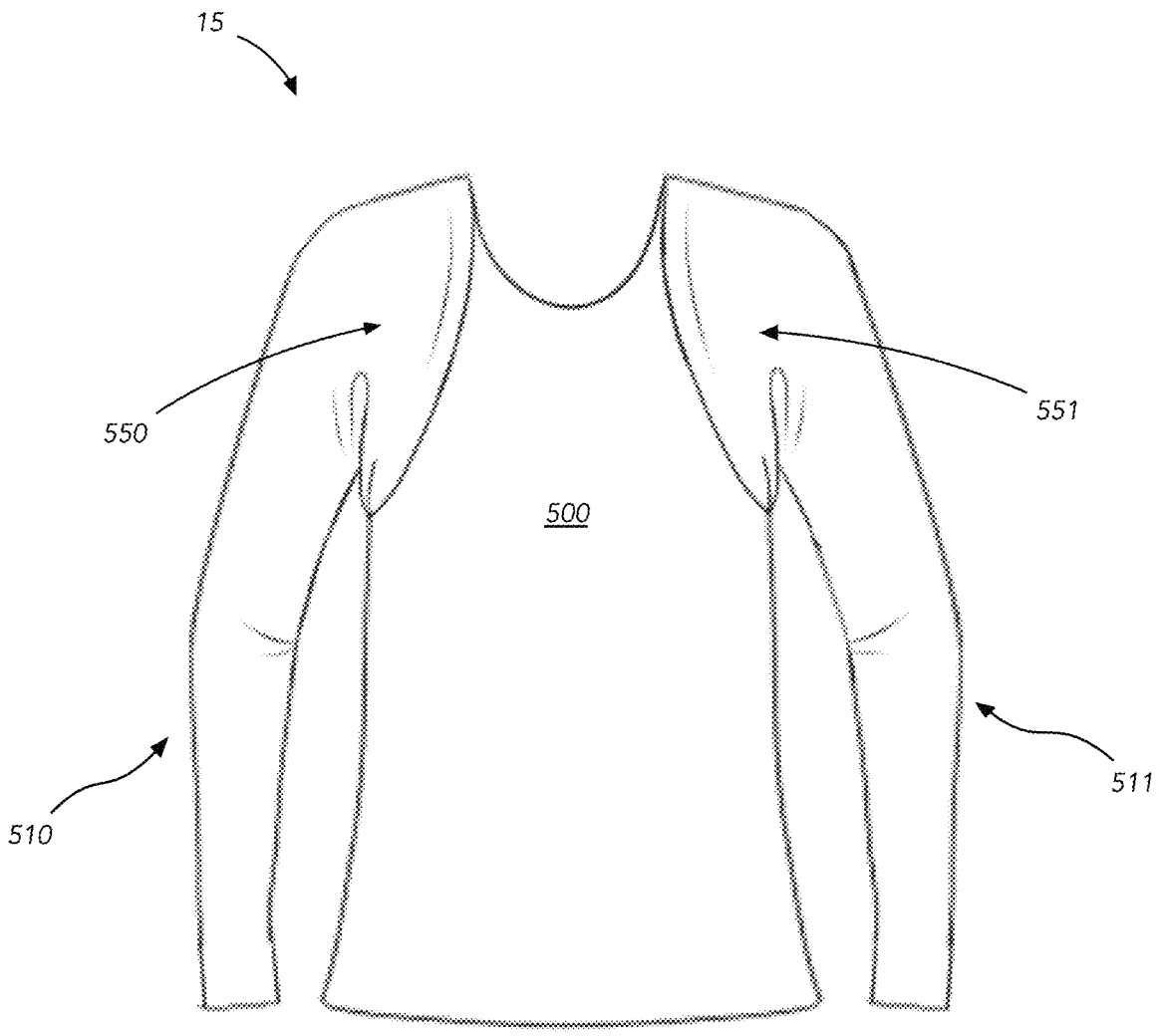
FIG. 8A illustrates a front view of an embodiment of a garment with convertible sleeves and shoulder hoods.

FIG. 8A illustrates a front view of yet another exemplary garment 15 according to the invention. The garment 15 comprises a garment body 500 and a pair of convertible sleeves 510, 511 as before. The garment further comprises a shoulder hood 550, 551 covering each respective shoulder in the sleeves-on configuration and coupled to the respective sleeves 510, 511. This provides a shrug or cardigan-style garment with convertible sleeves.

Figure 8B:
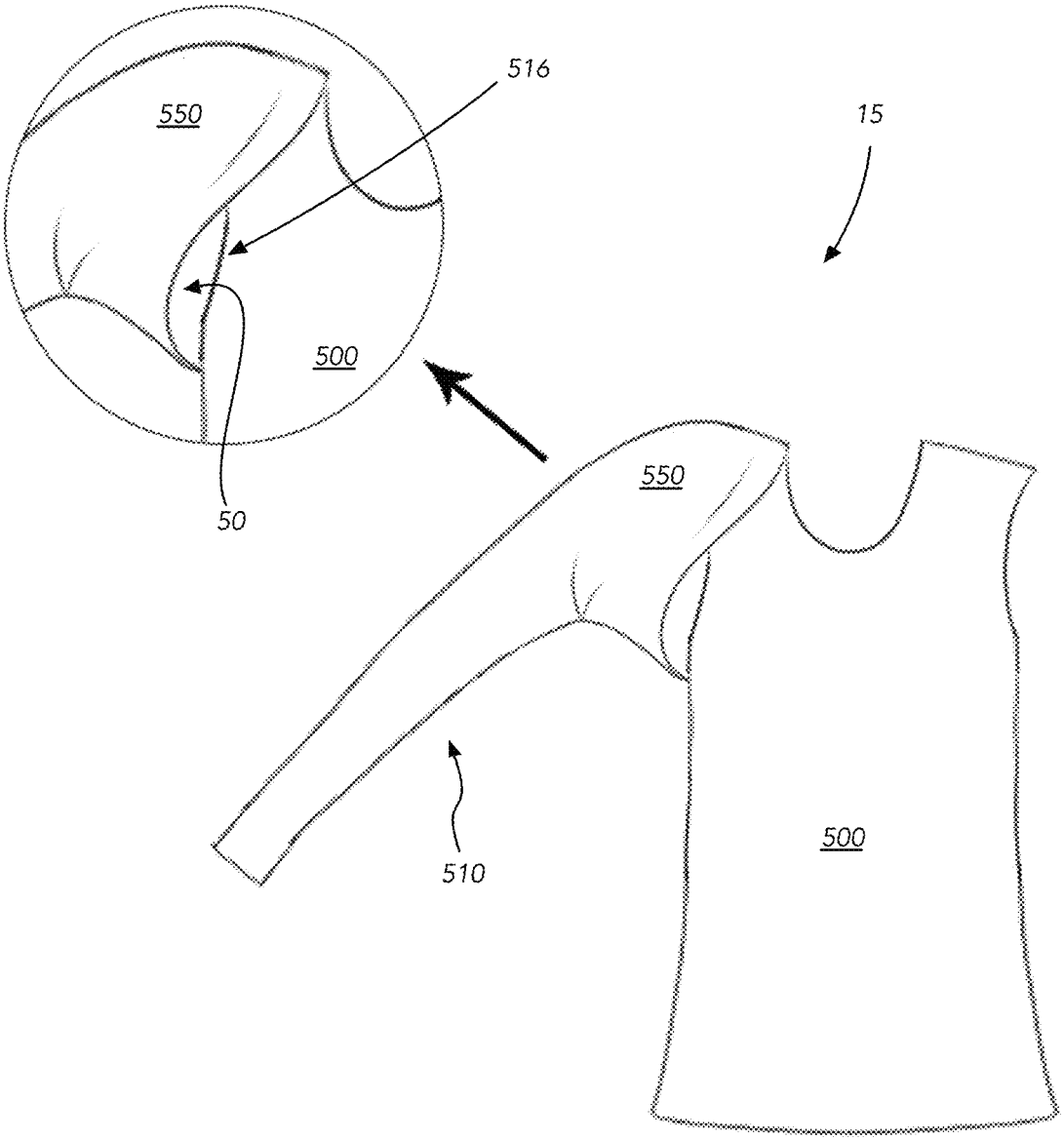
FIG. 8B illustrates another front view of the previous garment with the arm raised up to reveal the arm hole under the shoulder hood.

FIG. 8B illustrates the garment 15 of the previous view with the right sleeve 510 raised to reveal the attachment location 516 and arm hole 50 under the shoulder hood 550. The left arm would be similarly arranged but is not shown for simplicity. Again, the garment 15 allows the sleeves to be worn in a first (sleeves-on) configuration or in a second (sleeves-off) configuration as described and shown.

Figure 9:
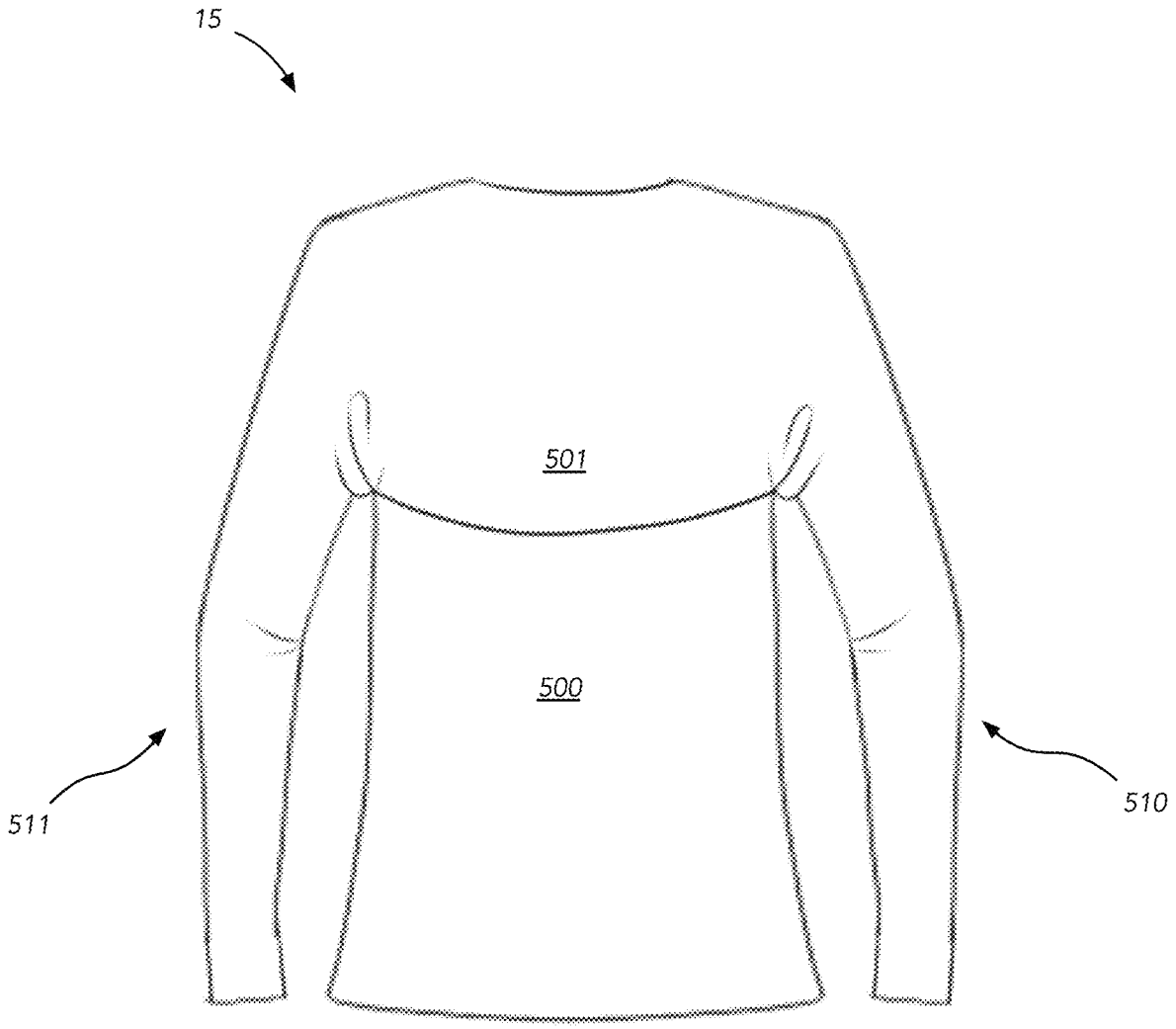
FIG. 9 illustrates the previous garment in the sleeves-on configuration from the back.

FIG. 9 illustrates the embodiment of FIG. 8 above, from the back, in the sleeves-on configuration. We see that the shoulder hoods of the last figure are coupled to or integrally formed with a rear cape or drape 501 that hangs from the upper part of the garment partially down to cover a part of the garment body 500 from the back. Again, the sleeves are in the sleeves-on configuration as shown in FIG. 9.

Figure 10:
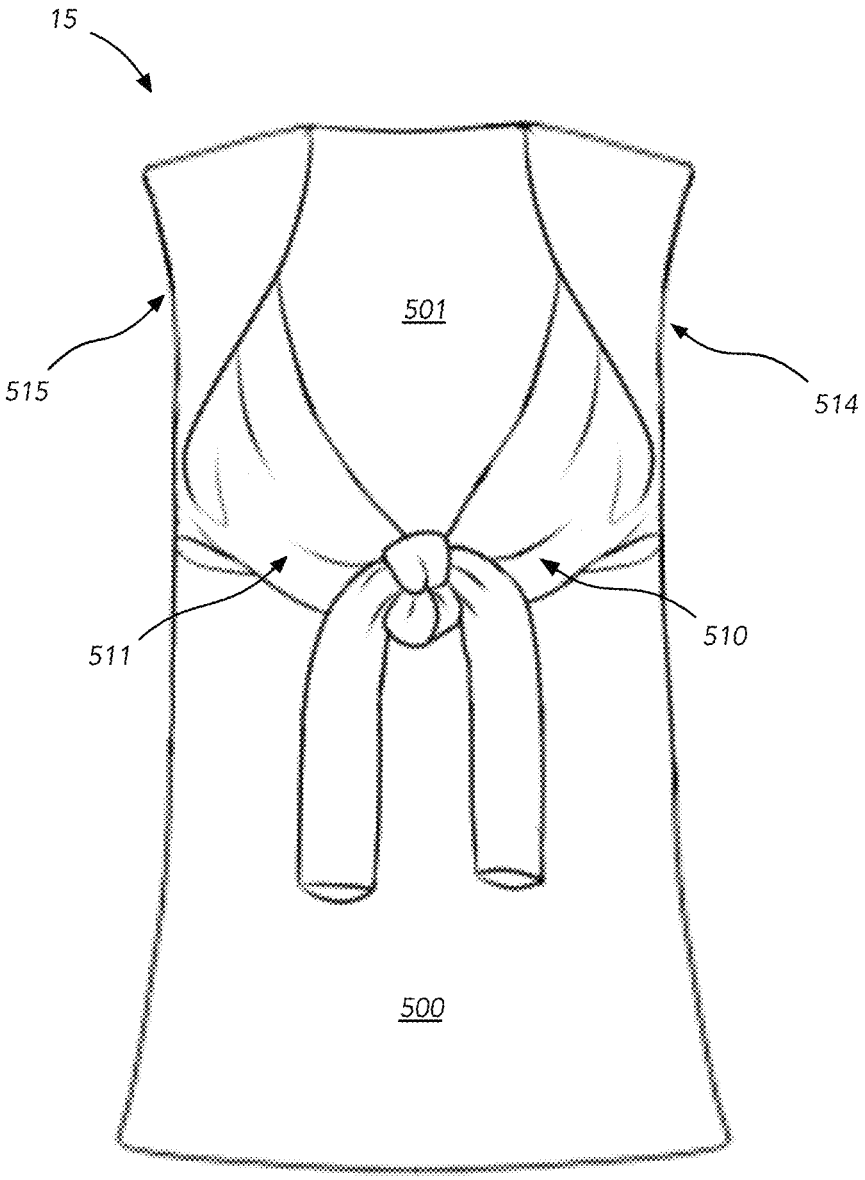
FIG. 10 illustrates the previous garment from the back in the sleeves-off configuration with the sleeves tied behind the wearer's back.

FIG. 10 illustrates the garment 15 from a back view in the sleeves-off configuration. Sleeves 510, 511 are doffed and worn behind the back, and may be optionally tied together as shown, placed into sleeve stays as described earlier, or otherwise secured for comfort and style. The sleeves 510 and 511 are convertibly permanently and partially connected to the garment body 500 at the respective connection locations at the respective arm openings 514, 515.

Figure 11A:
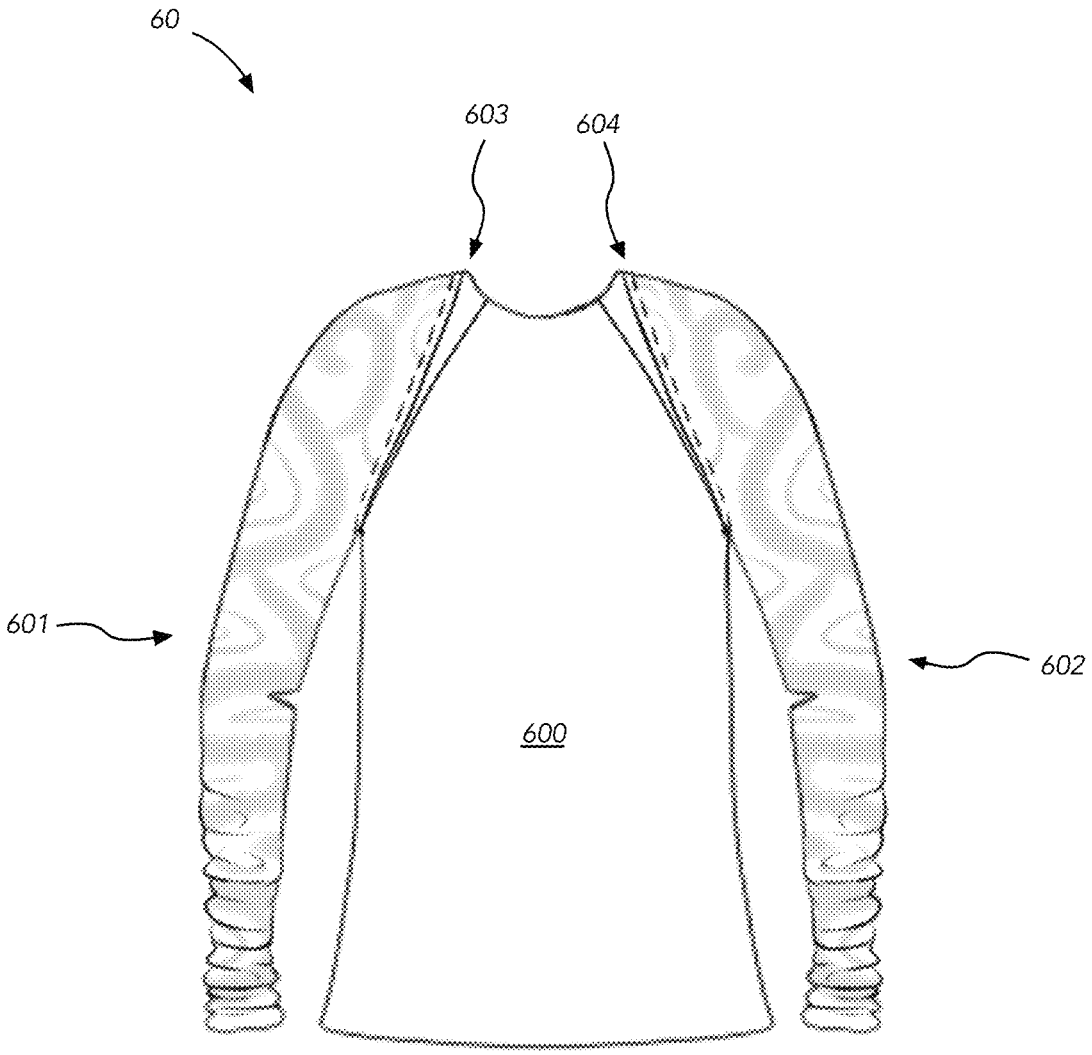
FIG. 11A illustrates a garment with convertible stretchable sleeves in a front view.

FIG. 11A illustrates a front view of a garment 60 having a garment body portion 600 worn about the user's waist and convertible arm sleeves 601 (right arm sleeve) and 602 (left arm sleeve). The sleeves are coupled in a partially connected way as described above at one or more locations subtending a portion of the armscye area connecting garment body 600 and sleeves 601, 602. In these or other embodiments, at least some parts of garment 60 comprise a stretchable fabric or material. For example, the shaded parts (sleeves 601, 602) may be constructed of a stretchable fabric or composite including stretchable fabric such as lycra, elastane, spandex or other natural or synthetic fabric materials in addition to blends and combinations thereof. Relative to conventional non-stretching fabrics, the stretchable fabric portions 601, 602 of garment 60 are ones that can change their dimensions (stretch) under force without tearing or becoming permanently deformed and where such force is from ordinary donning and doffing activities by a wearer who is pulling the sleeves 601, 602 on or off his/her arms to convert the garment 60 from a sleeves-on configuration to a sleeves-off configuration and back. The stretchable fabric material can be applied as would be apparent to someone of skill in the art to stretch (expand from its relaxed state under force) along one or more dimensions of the fabric as suits a given garment design. Also, the nature and amount of stretch can be selected by a designer skilled in the art as necessary based on the design and size of the garment and its wearer. In some examples, stretchable fabric can extend without damage to greater than 10% of its natural, relaxed, unstretched state, under suitable force, or even to an extent of greater than 25% or greater than 50% of its relaxed dimension without permanent damage.

In some aspects, having stretchable portions of the garment allows the wearer to more easily extend a stretchable portion thereof so as to bring his/her arms in/out of the convertible sleeves. In some examples, the entire sleeves 601, 602 can be constructed of said stretchable fabric material, or that a portion of the sleeves less than said entire sleeves can be made of stretchable material, especially at or near the interfaces 603, 604 between the sleeves and the garment body 600. Furthermore, those skilled in the art will understand that the armscye portion of garment 60 itself can comprise or be surrounded by a stretchable fabric material portion integrated or sewn or adhered to one or more parts of the garment 60 (e.g., at sleeves 601, 602, at arm openings 603, 604, the upper portion of garment body 600). In yet other embodiments, the entire garment 60 (and optionally the threads used in sewing some or all of it) may be made of a stretchable fabric and/or thread material to accommodate the maximum or optimum stretching ability to allow putting the convertible arm sleeves on and off. Again, the arm sleeves in all present embodiments are at least partially permanently connected to the garment body proximal to the arm openings thereof and are not fully detachable from the garment body as discussed above.

Figure 11B:
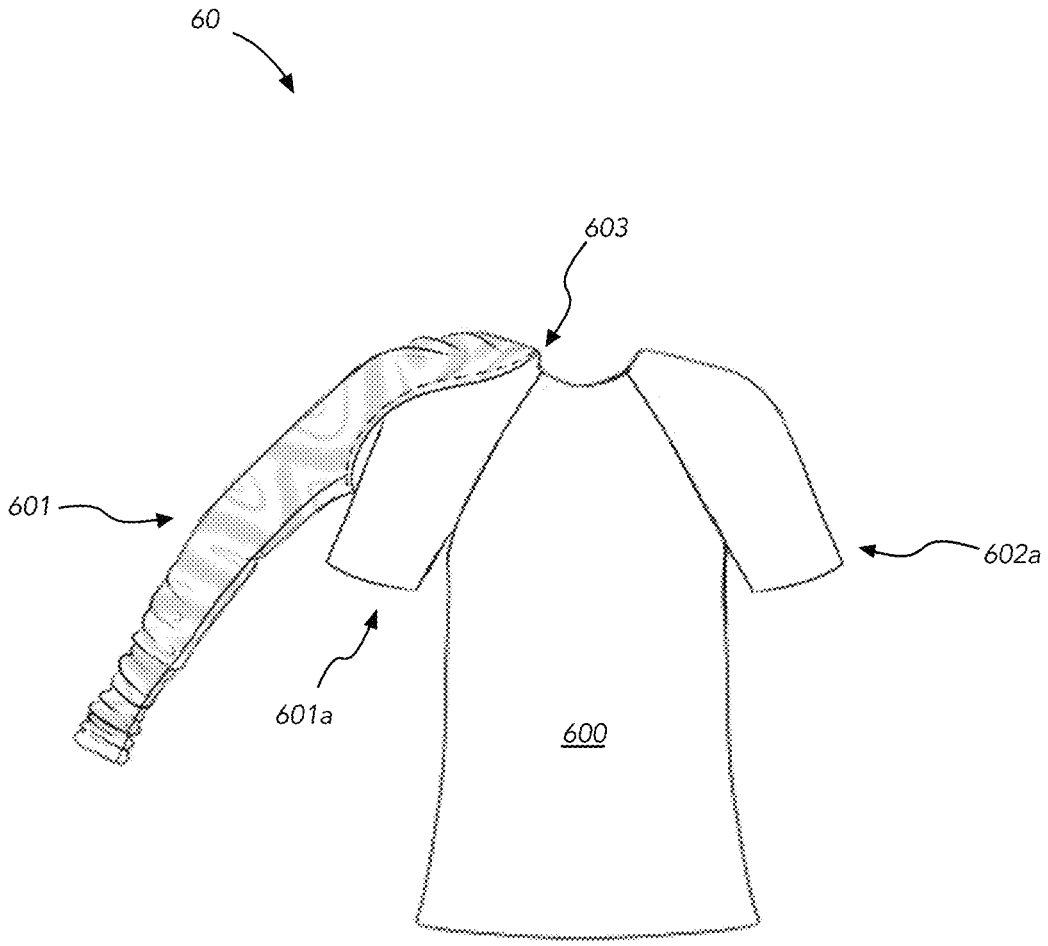
FIG. 11B illustrates the garment of the previous figure showing an arm sleeve and underlying sleevelet.

FIG. 11B illustrates another front view of garment 60 with convertible sleeves. Right arm sleeve 601 is shown only for simplicity in the drawing, but a corresponding similar left arm sleeve would operate equivalently. The sleeve 601 is partially permanently affixed to garment body 600 at a connection location 603 near the arm hole of the garment and may include a short sleevelet 601*a* (602*a*) worn over the wearer's upper arms or shoulders. The long sleeve 601 can be pulled off of the wearer's arm to go from a sleeves-on configuration to a sleeves-off configuration where the stretchable fabric of sleeve 601 facilitates pulling the sleeve 601 off the wearer's right arm as desired.

Figure 11C:
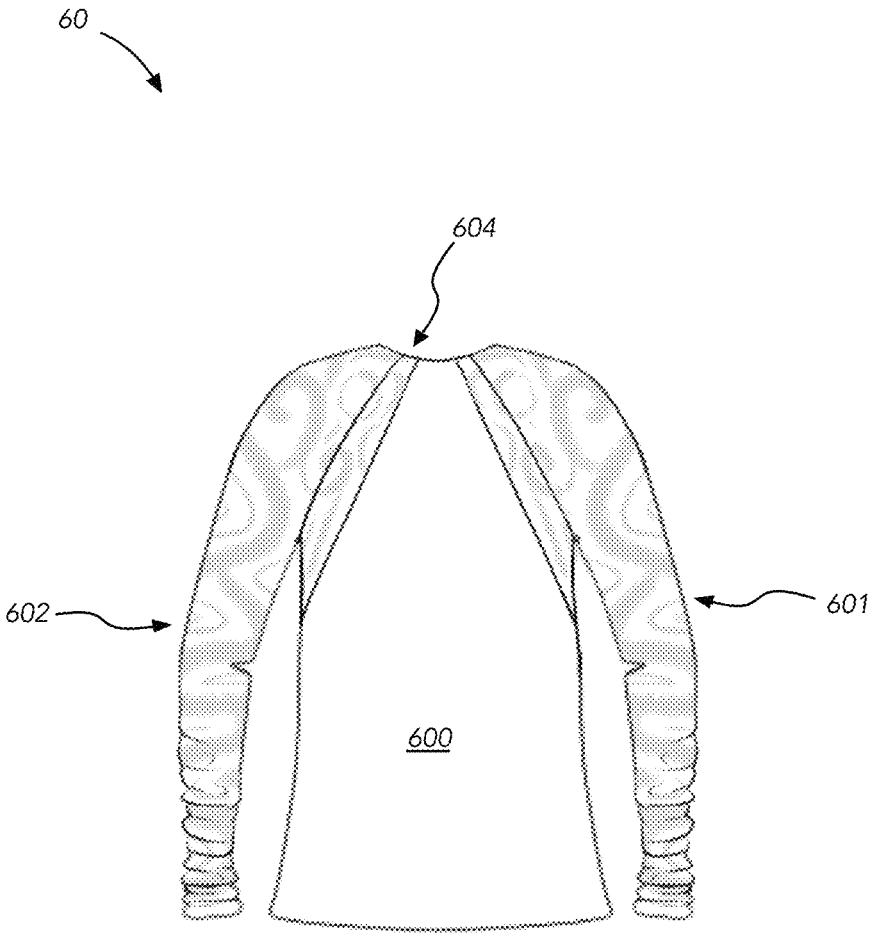
FIG. 11C illustrates a rear view of the previous drawings' garment in a sleeves-on configuration

FIG. 11C illustrates a rear/back view of garment 60 as it would appear in the sleeves-on configuration.

Figure 12:
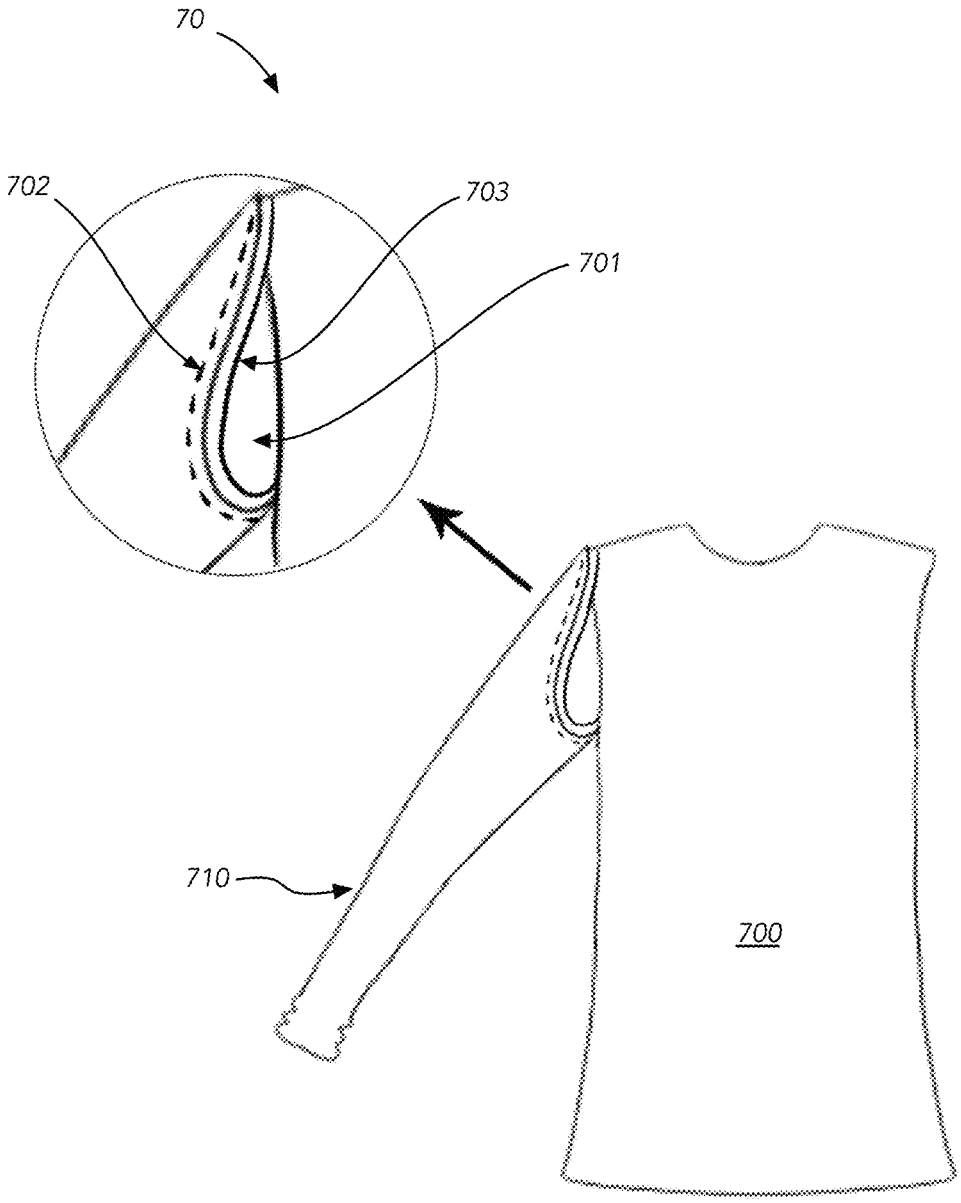
FIG. 12 illustrates a garment with convertible arm sleeves having a stretchable fabric arm opening surround.

FIG. 12 illustrates a garment 70 with convertible sleeves as described herein (albeit only the right arm sleeve 710 is shown for simplicity of the drawing, though a left arm sleeve would appear and operate correspondingly). In this embodiment, the sleeve 710 is attached to the garment body 700 as described before, leaving an arm opening 701 forming a stretchable arm opening surround through which the wearer can insert and remove his/her arm to convert the garment between the sleeves-on and sleeves-off configurations. A seam 702 and a portion 703 of the garment are shown in a detailed view wherein the portion 703 is made of a stretchable fabric material as described earlier. The portion 703 of stretchable fabric can be narrow or wide and encompass less than the full length of arm sleeve 710 as suitable for a given design or need. The stretchable portion 703 would allow some expansion of the area of the opening 701 through which the wearer moves his/her arm to convert the sleeve.

Therefore, the present garment designs are innovatively configured and arranged to overcome inconvenience of needing to take off an entire outer garment such as a jacket or sweater because this invention can allow the wearer to merely remove his or her arms from the garment and use it in the sleeves-off configuration. Also, unlike prior designs where sleeves are completely detachable (and can be lost or need stowage and carrying) the present embodiments allow for the sleeves to be doffed but remaining securely attached to the garment body.

It is again noted that several examples and preferred embodiments are set forth above. These are not given by way of limitation, but instead to best illustrate the invention and disclosed systems and methods. Those skilled in the art will understand upon reviewing the present disclosure that some components or steps may be optional and omitted, others may be added, without loss of generality. Equivalent or substitute components or steps may also be applied, remaining within the scope of the invention captured by the disclosure. For example, the location of the arm openings in each embodiment described can be disposed at or near the front of the respective armscye, the rear thereof, the top thereof, and/or the bottom thereof.

What is claimed is:

1. A garment having convertible arm sleeves, comprising:

a garment body;

the garment body having a right arm opening and a left arm opening, the right arm opening having a perimeter, and the left arm opening having a perimeter separate from the perimeter of the right arm opening;

a first pair of sleeves comprising:

a left arm sleeve, having an upper portion partially yet permanently connected to said garment body, the upper portion of the left arm sleeve permanently connected to said garment body along a portion of the perimeter of said left arm opening of the garment body so that the left arm sleeve is convertibly coupled to said garment body proximal to said left arm opening; and a right arm sleeve, having an upper portion partially yet permanently connected to said garment body, the upper portion of the right arm sleeve permanently connected to said garment body along a portion of the perimeter of said right arm opening of the garment body so that the right arm sleeve is convertibly coupled to said garment body proximal to said right arm opening;

wherein the left and right arm sleeves and respective connection locations on the garment body configures said arm sleeves to be worn in a sleeves-on configuration and to be worn in a sleeves-off configuration;

wherein said upper portion of said left arm sleeve is sewn, glued or woven to said garment body along a portion of the perimeter of said left arm opening of the garment body; and wherein said upper portion of said right arm sleeve is sewn, glued or woven to said garment body along a portion of the perimeter of said right arm opening of the garment body;

a second pair of sleeves, being permanently connected around an entire perimeter of said respective arm openings, comprising:

a left arm sleeve sewn, glued or woven to said garment body around the entire perimeter of said left arm opening of the garment body; and a right arm sleeve sewn, glued or woven to said garment body around the entire perimeter of said right arm opening of the garment body.

2. The garment of claim 1, said connection locations of said respective first pair of sleeves being at a rearward portion of the respective arm openings at which the garment body and said arm sleeves are permanently connected, and leaving a frontward portion at the respective arm openings unattached to said respective first pair of sleeves.

3. The garment of claim 1, wherein the first pair of sleeves have a length thereof, the first pair of sleeves being convertible between said sleeves-on and said sleeves-off configurations, the second pair of sleeves having a length shorter than the length of the first pair of sleeves.

4. The garment of claim 1, wherein at least a portion of said right and left arm sleeves of said first pair of sleeves comprise a stretchable fabric material at an upper part thereof so that said stretchable fabric material can be stretched.

5. The garment of claim 1, wherein at least a portion of said garment body proximal to said right and left arm openings comprise a stretchable fabric material at an upper part thereof so that said stretchable fabric material can be stretched.

6. The garment of claim 3, wherein said second pair of sleeves that have a length shorter than the length of the first pair of sleeves and are permanently around an entire perimeter of said respective arm openings comprise:

the left arm sleeve is shorter in length than the left arm sleeve of said first pair of sleeves and has an upper portion permanently around the entire perimeter of said left arm opening of the garment body; and the right arm sleeve is shorter in length than the right arm of said first pair of sleeves and has an upper portion permanently around the entire perimeter of said right arm opening of the garment body;

wherein if said first pair of sleeves are in a sleeves-on configuration:

the left arm sleeve of the second pair of sleeves is disposed inside the upper portion of the first pair of sleeves' left arm sleeve permanently connected to said garment body along a portion of the perimeter of said left arm opening of the garment body;

and the right arm sleeve of the second pair of sleeves is disposed inside the upper portion of the first pair of sleeves' right arm sleeve permanently connected to said garment body along a portion of the perimeter of said right arm opening of the garment body; and wherein if said first pair of sleeves are in a sleeves-off configuration:

the left arm sleeve of the second pair of sleeves has a free end that is free of said first pair of sleeves' left arm sleeve permanently connected to said garment body along a portion of the perimeter of said left arm opening of the garment body; and the right arm sleeve of the second pair of sleeves has a free end that is free of said first pair of sleeves' right arm sleeve permanently connected to said garment body along a portion of the perimeter of said right arm opening of the garment body.

7. The garment of claim 1, wherein said upper portion of said left arm sleeve of said first pair of sleeves is sewn to said garment body along a portion of the perimeter of said left arm opening of the garment body; and wherein said upper portion of said right arm sleeve of said first pair of sleeves is sewn to said garment body along a portion of the perimeter of said right arm opening of the garment body.

8. The garment of claim 1, wherein said upper portion of said left arm sleeve of said first pair of sleeves is glued to said garment body along a portion of the perimeter of said left arm opening of the garment body; and wherein said upper portion of said right arm sleeve of said first pair of sleeves is glued to said garment body along only a portion of the perimeter of said right arm opening of the garment body.

9. The garment of claim 1, wherein said upper portion of said left arm sleeve of said first pair of sleeves is woven to said garment body along a portion of the perimeter of said left arm opening of the garment body; and wherein said upper portion of said right arm sleeve of said first pair of sleeves is woven to said garment body along a portion of the perimeter of said right arm opening of the garment body.

10. The garment of claim 3, wherein said second pair of sleeves that have a length shorter than the length of the first pair of sleeves and are permanently around an entire perimeter of said respective arm openings comprise: the left arm sleeve that is shorter in length than the left arm sleeve of said first pair of sleeves and has an upper portion sewn to said garment body around the entire perimeter of said left arm opening of the garment body; and the right arm sleeve that is shorter in length than the right arm sleeve of said first pair of sleeves and has an upper portion sewn to said garment body around the entire perimeter of said right arm opening of the garment body.

11. The garment of claim 3, wherein said second pair of sleeves that have a length shorter than the length of the first pair of sleeves and are permanently around an entire perimeter of said respective arm openings comprise: the left arm sleeve that is shorter in length than the left arm sleeve of said first pair of sleeves and has an upper portion glued to said garment body around the entire perimeter of said left arm opening of the garment body; and the right arm sleeve that is shorter in length than the right arm sleeve of said first pair of sleeves and has an upper portion glued to said garment body around the entire perimeter of said right arm opening of the garment body.

12. The garment of claim 3, wherein said second pair of sleeves that have a length shorter than the length of the first pair of sleeves and are permanently around an entire perimeter of said respective arm openings comprise: the left arm sleeve that is shorter in length than the left arm sleeve of said first pair of sleeves and has an upper portion woven to said garment body around the entire perimeter of said left arm opening of the garment body; and the right arm sleeve that is shorter in length than the right arm sleeve of said first pair of sleeves and has an upper portion woven to said garment body around the entire perimeter of said right arm opening of the garment body.

13. A garment having convertible arm sleeves, comprising:

a garment body;

the garment body having a right arm opening and a left arm opening through which a wearer's arms may extend;

a first pair of sleeves comprising:

a left arm sleeve, having an upper portion partially sewn, glued or woven to said garment body, the upper portion of the left arm sleeve sewn, glued or woven to said garment body along a portion of a perimeter of said left arm opening of the garment body so that the left arm sleeve is convertibly coupled to said garment body proximal to said left arm opening; and a right arm sleeve, having an upper portion only partially sewn, glued or woven to said garment body, the upper portion of the right arm sleeve sewn, glued or woven to said garment body along only a portion of a perimeter of said right arm opening of the garment body so that the right arm sleeve is convertibly coupled to said garment body proximal to said right arm opening;

wherein the left and right arm sleeves and respective connection locations on the garment body configures said arm sleeves to be worn on the wearer's arms in a sleeves-on configuration and to be worn off the wearer's arms in a sleeves-off configuration;

wherein said right arm sleeve has a length;

wherein said left arm sleeve has a length;

a second pair of sleeves sewn, glued or woven around an entire perimeter of said respective arm openings, said second pair of sleeves comprising:

a left arm sleeve that is shorter in length than the length of the left arm sleeve of said first pair of sleeves and having an upper portion sewn, glued or woven to said garment body around the entire perimeter of said left arm opening of the garment body; and a right arm sleeve that is shorter in length than the length of the right arm sleeve of said first pair of sleeves and having an upper portion sewn, glued or woven to said garment body around the entire perimeter of said right arm opening of the garment body; wherein if said first pair of sleeves are in a sleeves-on configuration:

the left arm sleeve of the second pair of sleeves is disposed inside the upper portion of the first pair of sleeves' left arm sleeve sewn, glued or woven to said garment body along a portion of the perimeter of said left arm opening of the garment body; and the right arm sleeve of the second pair of sleeves is disposed inside the upper portion of the first pair of sleeves' right arm sleeve sewn, glued or woven to said garment body along a portion of the perimeter of said right arm opening of the garment body; and wherein if said first pair of sleeves are in a sleeves-off configuration:

the left arm sleeve of the second pair of sleeves has a free end that is free of said first pair of sleeves' left arm sleeve sewn, glued or woven to said garment body along a portion of the perimeter of said left arm opening of the garment body; and the right arm sleeve of the second pair of sleeves has a free end that is free of said first pair of sleeves' right arm sleeve sewn, glued or woven to said garment body along a portion of the perimeter of said right arm opening of the garment body.

14. The garment of claim 13, wherein said upper portion of said left arm sleeve is sewn to said garment body along a portion of the perimeter of said left arm opening of the garment body;

wherein said upper portion of said right arm sleeve is sewn to said garment body along a portion of the perimeter of said right arm opening of the garment body;

wherein the upper portion of the left arm sleeve of the second pair of sleeves that is shorter in length than the length of the left arm sleeve of said first pair of sleeves is sewn to said garment body around the entire perimeter of said left arm opening of the garment body; and wherein the upper portion of the right arm sleeve of the second pair of sleeves that is shorter in length than the length of the right arm of said first pair of sleeves is sewn to said garment body around the entire perimeter of said right arm opening of the garment body.

* * * * *